United States Patent [19]

Krehbiel

[11] Patent Number: 4,544,366

[45] Date of Patent: Oct. 1, 1985

[54] SHEARING APPARATUS

[76] Inventor: Eldon W. Krehbiel, Rte. 2, Hydro, Okla. 73048

[21] Appl. No.: 464,921

[22] Filed: Feb. 8, 1983

Related U.S. Application Data

[63] Continuation-in-part of Ser. No. 012,851, Feb. 16, 1979, abandoned.

[51] Int. Cl.[4] ..... B26B 19/24

[52] U.S. Cl. ..... 30/216; 30/296 R

[58] Field of Search ..... 30/296 R, 215, 219

[56] References Cited

U.S. PATENT DOCUMENTS

| | | | |
|---|---|---|---|
| 5,972 | 7/1874 | Kennedy | 30/215 |
| 52,293 | 1/1866 | Kennedy | 30/215 |
| 926,130 | 0/1909 | McQuoid . | |
| 973,696 | 10/1910 | Ponath . | |
| 1,303,908 | 5/1919 | Johnson | 30/296 |
| 1,352,326 | 9/1920 | Swatzell | 30/216 |
| 1,357,444 | 11/1920 | Cox . | |
| 1,360,778 | 11/1920 | Neel | 30/216 |
| 1,396,507 | 11/1921 | Coffman . | |
| 2,662,412 | 12/1953 | Miller . | |
| 4,151,125 | 0/1889 | Richardson . | |

FOREIGN PATENT DOCUMENTS

| | | | |
|---|---|---|---|
| 605053 | of 1978 | Switzerland . | |
| 906 | of 1908 | United Kingdom | 30/216 |
| 466292 | of 1937 | United Kingdom | 30/216 |

OTHER PUBLICATIONS

Sheep Shearing, Bartlett, Breeder Publication, 1938, pp. 52, 53.

Dayton Electric Mfg. Co., Chicago, Ill., "Flexible Shaft"-Form 920.

Farmers Bulletin 1710, "Range Sheep Production", pp. 20–23.

Mechanical Power Transmission, Component Selection and Application, Greenwood, pp. 122–133, McGraw-Hill Book Company, Inc. 1962.

*Primary Examiner*—Jimmy C. Peters

[57] ABSTRACT

An improved sheep shearing apparatus comprising a motor suspended from an overhead member by a suspension apparatus, the motor having a drive shaft which is oriented vertically downward and is connected via a flexible shaft assembly to a clipper head assembly. The flexible shaft assembly is characterized as having a sufficient length and torsion resistance such that wherein the clipper head assembly encounters a load during the shearing procedure the flexible shaft assembly resists twisting. The length of the flexible shaft assembly is approximately equal to the vertical distance between the motor and the working surface on which the sheep is to be sheared.

6 Claims, 3 Drawing Figures

SHEARING APPARATUS

CROSS REFERENCE TO RELATED APPLICATION

This is a continuation-in-part application of copending patent application entitled "Shearing Apparatus", U.S. Ser. No. 012,851, filed Feb. 16, 1979 now abandoned.

FIELD OF THE INVENTION

The present invention relates to shearing machines, and more particularly but not by way of limitation, to an improved shearing machine for shearing wool from sheep having a clipper head connected by a flexible shaft to a remote electric motor disposed above the working surface, the flexible shaft being characterized as having a sufficient length and torsion resistance to prevent twisting of the flexible shaft when the clipper head encounters load during the shearing procedure.

BACKGROUND

In shears for removing wool from sheep, it has been conventional to utilize a mechanically operated clipper head which is driven by an extended rotating shaft which is powered by a remote electric motor. Such a unit features a lightweight clipper head which dissipates a minimal amount of thermal energy, a feature which is highly desirable from the standpoint of an operator's convenience and comfort. Furthermore, the conventional clipper head produces relatively little noise which might frighten an animal and thereby cause injury to the animal or damage to its fleece. Thus, while shears having a self-contained electric motor are also known, the more favorable heat, weight and noise characteristics of the remote motor design have established it as the dominant design for commercial sheep shearing equipment in the United States and abroad.

One type of remote motor shearing machine which has heretofore been used is one in which a rigid rotating shaft connects the clipper head to the remote motor. In order to impart sufficient angular and translational mobility to the clipper head, so that it may easily reach all portions of the animal to be sheared, one or more knuckle joints are interposed in the rigid shaft. Hinges in these joints permit shaft movement, while the knuckles transmit the rotational motion of each shaft element through the joint toward the clipper head.

The combination jointed shaft and remote motor shearer, despite widespread use, is subject to a number of shortcomings. Increasing the maneuverability of the shaft, as required for maximum ease of shearing, can be accomplished only by increasing the number of knuckle joints in the shaft, which in turn increases the difficulty of maintaining the shaft in proper position during shearing. Further, the exposed gears which rotate in each knuckle joint present a significant safety hazard to persons or animals that may be caught and injured in the gears. Elimination of this hazard, by shielding the gears in each joint, can be accomplished only at the cost of restraining the flexibility of each joint and thus reducing the manueverability of the apparatus. A further safety problem associated with the rigid shaft shears arises when the blades of the clipper head are stopped by a heavy shearing load and the shaft is thereby caused to twist or swing by the excess torque developed by the motor. Such a moving shaft presents a significant hazard to persons and animals in the work area, primarily because of the danger of being struck by one of the shaft's relatively heavy knuckle joints. In view of these problems, and in light of the trend of increasingly strict governmental safety regulations for the workplace, it is possible that a safer substitute will be required for the rigid jointed shaft/remote motor shearing machine at some point in the future.

Replacement of the rigid jointed shaft by a flexible shaft in a remote motor shearing unit eliminates many of the above-described disadvantages. A flexible shaft offers substantially unrestricted mobility for the clipper head of the shears unit, while offering greater safety as well, because the flexible shaft carries no exposed gears or heavy joints which may injure persons or animals in the shearing area. Because a flexible shaft unit also lacks much of the expensive gearing of its rigid jointed shaft counterpart, it may be produced and maintained at a lower cost as well. Examples of flexible shaft shearing apparatus include Great Britain Pat. No. 906 of 1908, issued to Bousfield; Great Britain Pat. No. 466,292, issued to Macnamara, et al.; U.S. Pat. No. 973,696, issued to Ponath; and U.S. Pat. No. 2,662,412, issued to Miller.

Notwithstanding its advantages over the rigid jointed shaft, the flexible shaft shearing machines of the prior art have found little acceptance in commercial sheep shearing in the United States, and, as far as is known, only a limited acceptance abroad. The reason for this lack of acceptance rests in the behavior of prior art flexible shaft apparatus when the clipper head encounters a heavy shearing load. When this occurs, the torque produced by the motor cannot be transmitted in whole to the clipper head because the load on the clipper head prevents full-speed action by the clipper blades of the clipper head. Torque transmission through the flexible shaft is further hindered by bending of the shaft, which obstructs its turning motion. In this situation, which may occur frequently with the shaft characteristics of prior art devices, excess motor torque will be transmitted to the shaft itself, and to its housing, thereby causing the shaft to twist around itself.

When twisting of the shaft occurs, transmission of power to the clipper head is stopped and shearing must be discontinued until the operator can shut off the motor and thereafter untwist the flexible shaft. Since the operator of present day sheep shearing equipment generally holds the animal while the shears are operated, the operator must ordinarily release the animal before untwisting the shaft and must thereafter recapture and reorient the animal to the appropriate position before shearing may resume. Such a process is not only time consuming in itself, but also threatens to frighten the animal and thereby increase its resistance to further shearing, which may result in further delays or in possible injury to the animal. Further, interruption of the shearing may render it impossible to remove the animal's fleece in a single piece, or may require the making of second cuts to complete the shearing. Either of these eventualities is likely to reduce the quality and value of the wool ultimately obtained.

Because of the difficulties associated with twisting cable, prior art flexible shaft shearing apparatus have generally been suitable only for relatively very light shearing loads which do not cause the motor to develop sufficient excess torque to cause twisting of the shaft. For example, in Australia and New Zealand, flexible shaft/remote motor shears have found a limited use for "tagging", a process in which relatively short strokes are used to remove wool from the udder and tail areas of ewes prior to lambing. However, conventional rigid shaft equipment continues to be used in these countries for heavier shearing.

SUMMARY OF THE INVENTION

The present invention relates to an improved shearing apparatus supportable from a overhead member for shearing wool of a sheep positioned below the shearing apparatus on a working surface, the shearing apparatus having a flexible shaft assembly which substantially eliminates the problems encountered in the use of prior art shearing devices having flexible shafts, namely the twisting of the flexible shaft when the clipper head assembly of the apparatus encounters a load during the shearing operation. Because of the critical and unique features of the flexible shaft of the improved shearing apparatus of the present invention, and its relation to the positioning of the motor of the apparatus, the shaft remains relatively unbent during use and motor torque is transmitted continuously to the clipper head assembly when heavy shearing loads are encountered, thus preventing twisting of the flexible shaft and housing. Broadly, the present invention relates to an improved shearing apparatus having a drive assembly connectable to a clipper head assembly for shearing wool from a sheep wherein the drive assembly is supported by an overhead member at a position generally above a working surface on which the sheep is to be sheared. More specifically, the present invention relates to a shearing apparatus wherein the drive assembly of the shearing apparatus comprises a motor having a selectively rotatable drive shaft; a suspension assembly connectable to an overhead member for supporting the motor in an equilibrium position so that the drive shaft of the motor extends downwardly from the motor in a substantially vertical direction; a flexible shaft assembly connected to the drive shaft of the motor for transmitting rotational motion of the drive shaft; and a connector assembly for connecting the flexible shaft assembly to the clipper head assembly, the flexible shaft being characterized as having a sufficient length and torsion resistance such that in a connected position of the motor, the clipper head assembly, and the flexible shaft assembly, the length of the flexible shaft assembly is approximately equal to the vertical distance between the motor and the working surface and the flexible shaft assembly resists twisting when the clipperhead assembly encounters a load during the shearing of wool from a sheep.

An object of the present invention is to provide a shearing apparatus which may easily and maneuverably handle all types of shearing loads, without the safety hazards associated with rigid shaft shearing machines and without the costly interruptions due to twisting of the shaft which have characterized prior art flexible shaft designs when the clipper head assembly of the shearing apparatus encounters a load.

Other objects, advantages and features of the present invention will be apparent from the following detailed description when read in conjunction with the drawings and appended claims.

DESCRIPTION OF THE PREFERRED EMBODIMENT

Figure 1:
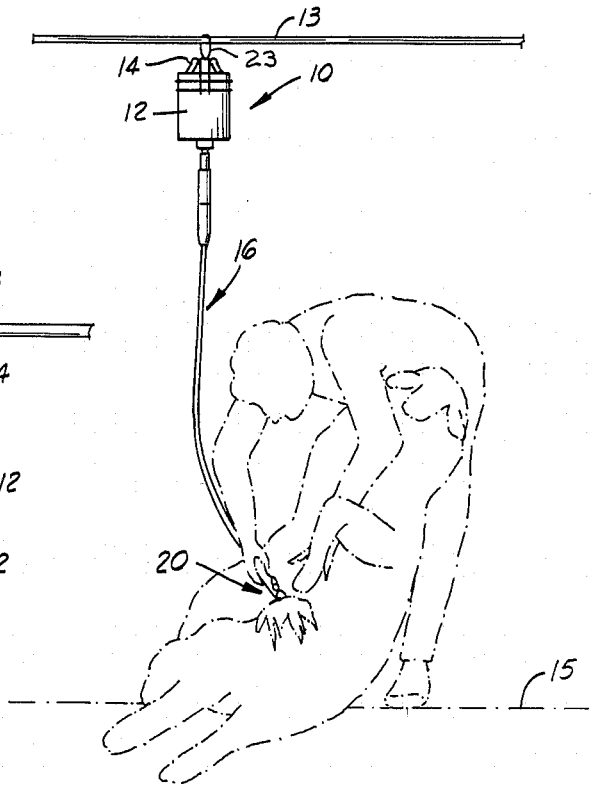
FIG. 1 is a view of the shearing apparatus of the present invention being used by an operator to shear a sheep.
Figure 2:
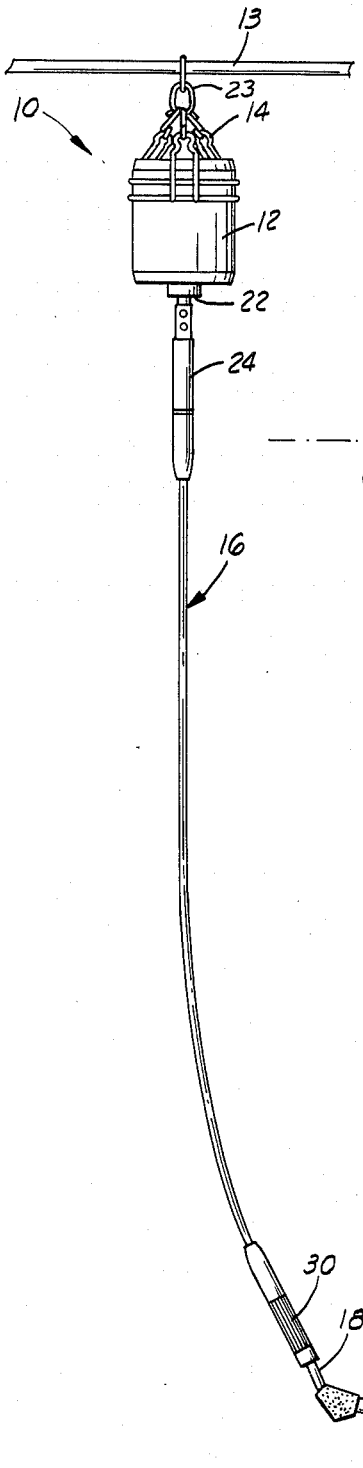
FIG. 2 is a detailed view of the shearing apparatus shown in FIG. 1.

Referring to the drawings, and particularly to FIGS. 1 and 2, the sheep shearing apparatus of the present invention, generally designated by the reference numeral 10, features a drive assembly comprising a motor 12 mounted on an overhead member 13 by a suspension apparatus 14. The drive assembly further comprises a flexible shaft assembly 16 which is connected at one end to the motor 12 and at its other end to a bayonet joint connector 18. The drive assembly is connected, via the bayonet joint connector 18, to a clipper head assembly 20.

The suspension apparatus 14, illustrated as a plurality of strands of chains cradling the motor 12 at various points about its periphery, secures the motor 12 of the shearing apparatus 10 to the overhead member 13 so that a rotatable drive shaft 22 of the motor 12 extends in a substantially vertical or downward position from the motor 12 in the direction of a working surface 15 on which sheep are to be sheared. The free ends of the chain strands are connected at a fixed suspension point to the overhead member 13 by any suitable means, such as ring assemblies 23. The overhead member 13 may consist of a rafter, beam or other appropriate support member. The motor 12 hangs in an equilibrium position directly below the overhead member 13, but may be moved by the suspension apparatus 14 freely in any direction from this position, such that the motor travels along a pendular path.

The motor 12, which supplies the motive power for the clipper head assembly 20 via the flexible shaft assembly 16, is preferably an electric motor, and is connected by conventional electrical connections (not shown) to a source of electric current. A suitable motor for purposes of the present invention is the Dayton Model 6K226, a 120 volt, $\frac{1}{3}$ horsepower motor available from Dayton Electric Manufacturing Company, Chicago, Ill. 60648. The motor 12 features the rotatable cylindrical drive shaft 22, which, when the motor 12 is in its equilibrium position, is oriented vertically downward by the suspension apparatus 14. Attached to the drive shaft 22 is the flexible shaft assembly 16 so that the flexible shaft assembly 16 transmits rotational motion of the drive shaft 22 of the motor 12 to the clipper head assembly 20.

Figure 3:
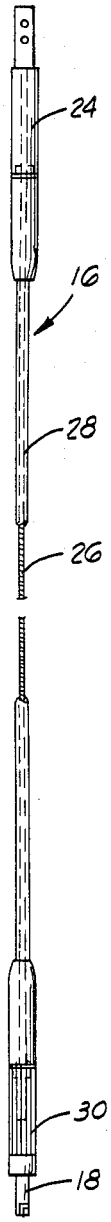
FIG. 3 is a view of the shaft assembly of the sheep shearing apparatus of FIG. 2, shown in partial cutaway view in order to display internal components.

The flexible shaft assembly 16, shown in FIG. 3, comprises a motor coupling member 24, a flexible shaft 26, a housing 28, and a clipper head coupling member 30. The motor coupling member 24 comprises a pair of coaxially engaged cylindrical sleeves, with one serving as a rotating sleeve and the other serving as a stationary sleeve. The drive shaft 22 of the motor 12 is connected to the rotating sleeve of the motor coupling member 24 by any suitable means, such as screws, so that the turning motion of the drive shaft 22 is transmitted to the rotating sleeve of the motor coupling member 24 while the stationary sleeve remains at rest. The rotating sleeve of the motor coupling member 24 features an internal transverse wall having a threaded aperture engaging one end of the flexible shaft 26, which extends through the stationary sleeve so that the rotating sleeve of the motor coupling member 24 effects transfer of rotational motion from the drive shaft 22 of the motor 12 to the flexible shaft 26.

The flexible shaft 26 transmits the rotational motion of the drive shaft 22 of the motor 12, via the rotating sleeve of the motor coupling member 24, to the clipper head assembly 20. To prevent undersirable twisting of the flexible shaft 26 when a load is encountered by the clipper head assembly 20 during shearing of wool with the shearing apparatus 10, while providing the degree of torsional strength and flexibility required for sheep shearing operations, the flexible shaft 26 must be constructed of a sufficient length and of a material having sufficient torsion or twisting resistance, while at the same time maintaining its flexible characteristics. Further, in order to prevent possible accidents or injuries due to the rapid rotating action of the flexible shaft 26, the flexible shaft is provided with the stationary housing 28 encompassing an inner flexible core shaft along its length. The housing 28 is in internally threaded connection at one of its ends to the stationary sleeve of the above described motor coupling member 24.

As previously stated, the flexible shaft assembly 16 is constructed so as to have a sufficient length (i.e. a length substantially corresponding to the vertical distance between the motor 12 and the working surface on which the sheep to be sheared is positioned) and of a suitable material to provide the desired flexible characteristics, without sacrificing the desired torsion or twisting resistance of the flexible shaft assembly 16 when a load is encountered by the clipper head assembly 20 during the shearing process. Desirable results have been obtained where the flexible shaft assembly is between about 50 and 70 inches in length and constructed of an inner core portion of precision wound steel wires wherein the diameter of the inner core is about 5/16 inches, and the inner core is encased in a polymeric housing having a thickness of about $\frac{1}{4}$ inch. A suitable cable having the desired flexibility and torsion or twisting resistance, especially for flexible shaft assemblies having a length of from about 50–70 inches, is the Dayton Flexible Shaft Model 2Z325, available from Dayton Electric Manufacturing Company, Chicago, Illinois 60648.

As shown in FIG. 3, both the flexible shaft 26 and its housing 28 terminate at a clipper head coupling member 30, which functions to transmit the rotating motion of the flexible shaft 26 to the clipper head assembly 20 via the bayonet joint connector 18. Much like the above described motor coupling member 24, the clipper head coupling member 30 comprises a pair of coaxially engaged cylindrical members, with one serving as a rotating member and the other serving as a stationary sleeve. The housing 28 terminates at an internally threaded connection within the stationary sleeve, while the flexible shaft 26 extends through the stationary sleeve and terminates in a threaded connection with the rotating member. The rotating member, which has a diameter of $\frac{3}{8}$ inch, transmits the motion of the flexible shaft 26 to the bayonet joint connector 18 and clipper head assembly 20, while the stationary sleeve, and the connected housing 28, remain at rest.

The rotating member of the clipper head coupling member 30 is in threaded engagement with one end of a connecting assembly comprising a bayonet joint connector 18, a conventional connection in the shearing art which is joined at its other end to the clipper head assembly 20, shown in FIG. 2. The clipper head assembly 20 comprises a rotatable driven shaft (not shown) which is connected at one end to the bayonet joint connector 18 and at the other end to cutter blades (not shown). Because the bayonet joint connector 18 is a standard fitting for substantially all clipper head assemblies sold in the United States, a wide variety of commercially available clipper head assemblies may be used with the present invention.

Prior to operation of the shearing apparatus 10, the motor 12 is suspended from the suspension apparatus 14 so that the vertical distance between the motor 12 and the working surface 15 is approximately equal to the maximum possible distance between the motor 12 and the extremity of the clipper head assembly 20. It has been found when the motor 12 is disposed substantially closer to the working surface 15 than the above stated limit that the amount of bending in the flexible shaft 26 required during shearing, particularly in reaching the head of an animal, will create a risk of twisting of the shaft assembly 16 when heavy shearing loads are encountered.

When the shearing apparatus 10 is to be operated, the motor 12 is actuated, causing the rotation of the drive shaft 22 and thus the rotation of the rotating sleeve of the motor coupling member 24. The flexible shaft 26, which is in threaded connection with the rotating sleeve, is thereby caused to rotate about its axis. Rotation of the flexible shaft 26 causes the rotating member of the clipper head coupling member 30, and the attached bayonet joint connector 18, to turn. This rotational motion is transmitted from the bayonet joint connector 18 to the driven shaft and cutter blades of the clipper head assembly 20, which then may be used for shearing an animal disposed on the working surface 15, as shown in FIG. 1. Because of the length, flexibility and torsion or twisting resistance of the shaft assembly 16, the clipper head assembly 20 will reach all portions of the animal easily, quickly and safely.

As the clipper head assembly 20 is moved back and forth over the animal being sheared; the distance between the clipper head assembly 20 and the equilibrium position of the motor 12 will change. In prior art units, this changing distance contributed to slack and bending in the flexible shaft, which led to twisting when a heavy shearing load was encountered. In the apparatus of the present invention, however, a combination of factors prevents the occurrence of twisting. First, the shaft assembly 16, with a specified length sufficient to extend only to the minimum length sufficient to reach all portions of an animal being sheared, in combination with its torsion or twisting characteristics, prevents twisting of the flexible shaft assembly 16 when the clipper head assembly 20 encounters a load during the shearing of a sheep.

Another factor contributing to the absence of twisting of the flexible shaft assembly 16 in the present apparatus is the vertically downward depending drive shaft 22 of the motor 12. The weight of the portion of the flexible shaft assembly 16 disposed adjacent to the drive shaft 12 causes the shaft assembly 16 to assume a substantially taut and linear vertical configuration, and allows the flexible shaft assembly 16 to maintain this configuration even when the clipper head assembly 20 is moved towards the equilibrium position of the motor 12. Because of its gravity-induced tautness, little slack develops in the shaft assembly 16 adjacent the drive shaft 12. If the drive shaft 12 were to extend horizontally from the motor 12, as in some prior art units, movement of the clipper head assembly 20 towards the motor would release tension in the shaft assembly, which would permit the shaft assembly to fall downwardly by its own weight. This would create a loop or curve in the shaft assembly in relation to the drive shaft, which could lead to twisting of the flexible shaft if heavy loading of the clipper head were to be encountered.

Still another factor contributing to the absence of twisting in the flexible shaft assembly 26 when the clipper head assembly 20 encounters a load during the shearing process is the suspension apparatus 14. The suspension apparatus 14 permits movement by the motor 12 to take up any slack in the shaft assembly 16 resulting from movement by the clipper head assembly 20 toward the equilibrium position of the motor 12. This movement of the motor 12 contributes to reduced shaft bending, thereby reducing the tendency of the flexible shaft assembly 26 to twist. It should be noted that a suspension apparatus 14 establishing larger distances between the overhead member 13 and the motor 12 is preferable for purposes of the present invention, because the movement of the motor 12, when held by a longer suspension apparatus, is more nearly horizontal. A horizontally moving motor 12 need not overcome the force of gravity, and thus may move more easily to compensate for slack which develops in the flexible shaft assembly 16.

The sheep shearing apparatus 10 of the present invention is subject to certain modifications. For example, if a faster cutting action is desired from the blades of the clipper head assembly 20, so that an animal may be sheared more quickly, a conventional belt-driven gear reducing means may be connected to the drive shaft 22 of the motor 12, and the flexible shaft assembly 16 in turn connected to the belt-driven gear reducing means. The design of such a gear reducing means is conventional, and will not be described for purposes of this application.

The present invention is well adapted to carry out the objects and attain the ends and advantages mentioned as well as those inherent therein. It will be understood that numerous further changes may be made which will readily suggest themselves to those skilled in the art and which are encompassed within the spirit of the invention and as defined in the appended claims.

What is claimed is:

1. An improved shearing apparatus supportable from an overhead member for shearing wool of a sheep positioned generally below the shearing apparatus on a working surface, the shearing apparatus comprising:

a motor having a selectively rotatable drive shaft;

suspension means connected to the over-head member for supporting the motor in an equilibrium position in which the drive shaft depends downwardly in a substantially vertical direction from the motor in a direction of the working surface, the suspension means permitting substantially free movement of the motor along a pendular path;

a clipper head assembly having cutter blades and a rotatable driven shaft, the cutter blades operable by rotation of the driven shaft;

a flexible shaft assembly connected to the drive shaft of the motor and the driver head of the clipper assembly for transmitting rotational motion of the drive shaft of the motor to the rotatable driven shaft of the clipper head assembly, the flexible shaft assembly having a length of from about 50 to about 70 inches and comprising an inner core portion formed of wound steel wires and a housing for encasing the core portion; and, a connector means for connecting the flexible shaft assembly to the clipper head assembly so that the rotatable head of the clipper head assembly is rotated and such that in the connected position of the motor, the clipper head assembly and the flexible shaft assembly, the flexible shaft assembly is approximately equal to the vertical distance between the motor of the working surface and the flexible shaft assembly resists twisting when the clipper head assembly encounters a load during the shearing of wool of sheep.

2. The improved shearing apparatus of claim 1 wherein the inner core is provided with a diameter of about 5/16 inch and the housing is provided with a thickness of about ¼ inch.

3. The improves shearing apparatus of claim 2 in which the suspension means comprises at least one strand of chain cradling the motor.

4. A drive assembly, supported by an overhead member, for connection to the clipper head assembly of a shearing apparatus, such shearing apparatus being for use in the shearing of wool from a sheep positioned generally below the drive assembly on a working surface, the drive assembly comprising:

a motor having a selectively rotatable drive shaft;

suspension means connected to the overhead member for supporting the motor in an equilibrium position in which the drive shaft depends downwardly in a substantially vertical direction from the motor, the suspension means further permitting substantially free movement of the motor along a pendular path;

a flexible shaft assembly connected to the drive shaft for transmitting rotational motion of the drive shaft, the flexible shaft assembly having a length of about 50 to about 70 inches and comprising an inner core portion formed of wound wires and a housing for encasing the core portion; and connector means for connecting the flexible shaft assembly to the clipper head assembly, the length and construction of the flexible shaft assembly, in combination with the positioning of the drive shaft of the motor and the suspension of the motor by the suspension means, maintaining the flexible shaft assembly in a substantially vertically disposed extended position between the rotatable drive shaft of the motor and the working surface so as to prevent the flexible shaft assembly from twisting when the clipper head assembly encounters a load during shearing of the wool from sheep.

5. The drive assembly of claim 4 wherein the inner core is provided with a diameter of 5/16 inch and the housing means is formed of a polymeric material having a thickness of about ¼ inch.

6. The drive assembly of claim 4 in which the suspension means comprises at least one strand of chain cradling the motor.

* * * * *